US006566033B1

(12) United States Patent
Majumdar et al.

(10) Patent No.: US 6,566,033 B1
(45) **Date of Patent: *May 20, 2003**

(54) CONDUCTIVE FOAM CORE IMAGING MEMBER

(75) Inventors: Debasis Majumdar, Rochester, NY (US); Narasimharao Dontula, Rochester, NY (US); Suresh Sunderrajan, Rochester, NY (US); Peter T. Aylward, Hilton, NY (US); Kelly S. Robinson, Fairport, NY (US); Melvin M. Kestner, Hilton, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/176,012

(22) Filed: Jun. 20, 2002

(51) Int. Cl.[7] ..... G03C 1/765; G03C 1/795; G03C 1/835; G03C 1/89; B41S 3/407

(52) U.S. Cl. ..... 430/201; 430/496; 430/502; 430/527; 430/529; 430/530; 430/536; 430/538; 347/106

(58) Field of Search ..... 430/527, 536, 430/496, 529, 530, 538, 201, 502; 347/106

(56) References Cited

U.S. PATENT DOCUMENTS

| | | | | |
|---|---|---|---|---|
| 4,832,775 | A | 5/1989 | Park et al. | 156/272.6 |
| 5,244,728 | A | 9/1993 | Bowman et al. | 430/527 |
| 5,683,862 | A | 11/1997 | Majumdar et al. | 430/527 |
| 5,719,016 | A | 2/1998 | Christian et al. | 430/527 |
| 5,731,119 | A | 3/1998 | Eichorst et al. | 430/527 |
| 5,851,651 | A | 12/1998 | Chao | 428/327 |
| 5,866,282 | A | 2/1999 | Bourdelais et al. | 430/536 |
| 5,888,643 | A | 3/1999 | Aylward et al. | 430/536 |
| 5,888,683 | A | 3/1999 | Gula et al. | 430/536 |
| 5,939,243 | A | 8/1999 | Eichorst et al. | 430/527 |
| 5,955,190 | A | 9/1999 | Majumdar et al. | 430/527 |
| 6,025,119 | A | 2/2000 | Majumdar et al. | 430/527 |
| 6,030,742 | A | 2/2000 | Bourdelais et al. | 430/536 |
| 6,060,229 | A | 5/2000 | Eichorst et al. | 430/527 |
| 6,077,655 | A | 6/2000 | Majumdar et al. | 430/527 |
| 6,096,491 | A | 8/2000 | Majumdar et al. | 430/527 |
| 6,120,979 | A | 9/2000 | Majumdar et al. | 430/527 |
| 6,124,083 | A | 9/2000 | Majumdar et al. | 430/527 |
| 6,162,596 | A | 12/2000 | Schwark et al. | 430/527 |
| 6,171,769 | B1 | 1/2001 | Majumdar et al. | 430/527 |
| 6,187,522 | B1 | 2/2001 | Majumdar et al. | 430/527 |
| 6,190,846 | B1 | 2/2001 | Majumdar et al. | 430/527 |
| 6,197,486 | B1 | 3/2001 | Majumdar et al. | 430/527 |
| 6,207,361 | B1 | 3/2001 | Greener et al. | 430/536 |
| 6,296,983 | B1 | 10/2001 | Gula et al. | 430/536 |
| 6,447,976 | B1 * | 9/2002 | Dontula et al. | 430/536 |

FOREIGN PATENT DOCUMENTS

| | | |
|---|---|---|
| JP | 97179241 | 7/1997 |

OTHER PUBLICATIONS

USSN 09/723,518, filed Nov. 28, 2000, Dontula et al., *Foam Core Imaging Member* (D–81644).

* cited by examiner

*Primary Examiner*—Richard L. Schilling
(74) *Attorney, Agent, or Firm*—Lynne M. Blank

(57) ABSTRACT

The invention relates to an imaging member and a method for use therewith comprising an imaging layer and a base wherein said base comprises a closed cell foam core sheet and adhered thereto an upper and lower flange sheet, and wherein said imaging member has a stiffness of between 50 and 250 millinewtons and is conductive.

49 Claims, No Drawings

CONDUCTIVE FOAM CORE IMAGING MEMBER

FIELD OF THE INVENTION

This invention relates to imaging media. In a preferred form, it relates to supports for photographic, ink jet, thermal, and electrophotographic media.

BACKGROUND OF THE INVENTION

In order for a print imaging support to be widely accepted by the consumer for imaging applications, it has to meet requirements for preferred basis weight, caliper, stiffness, smoothness, gloss, whiteness, and opacity. Supports with properties outside the typical range for 'imaging media' suffer low consumer acceptance.

In addition to these fundamental requirements, imaging supports are also subject to other specific requirements depending upon the mode of image formation onto the support. For example, in the formation of photographic paper, it is important that the photographic paper be resistant to penetration by liquid processing chemicals failing which there is present a stain on the print border accompanied by a severe loss in image quality. In the formation of 'photo-quality' ink jet paper, it is important that the paper is readily wetted by ink and that it exhibits the ability to absorb high concentrations of ink and dry quickly. If the ink is not absorbed quickly, the elements block (stick) together when stacked against subsequent prints and exhibit smudging and uneven print density. For thermal media, it is important that the support contain an insulating layer in order to maximize the transfer of dye from the donor, which results in a higher color saturation.

It is important, therefore, for an imaging media to simultaneously satisfy several requirements. One commonly used technique in the art for simultaneously satisfying multiple requirements is through the use of composite structures comprising multiple layers wherein each of the layers, either individually or synergistically, serves distinct functions. For example, it is known that a conventional photographic paper comprises a cellulose paper base that has applied thereto a layer of polyolefin resin, typically polyethylene, on each side, which serves to provide waterproofing to the paper and also provides a smooth surface on which the photosensitive layers are formed. In another imaging material as in U.S. Pat. No. 5,866,282, biaxially oriented polyolefin sheets are extrusion laminated to cellulose paper to create a support for silver halide imaging layers. The biaxially oriented sheets described therein have a microvoided layer in combination with coextruded layers that contain white pigments such as $TiO_2$ above and below the microvoided layer. The composite imaging support structure described has been found to be more durable, sharper, and brighter than prior art photographic paper imaging supports that use cast melt extruded polyethylene layers coated on cellulose paper. In U.S. Pat. No. 5,851,651, porous coatings comprising inorganic pigments and anionic, organic binders are blade coated to cellulose paper to create 'photo-quality' ink jet paper.

In all of the above imaging supports, multiple operations are required to manufacture and assemble all of the individual layers. For example, photographic paper typically requires a paper-making operation followed by a polyethylene extrusion coating operation, or as disclosed in U.S. Pat. No. 5,866,282, a paper-making operation is followed by a lamination operation for which the laminates are made in yet another extrusion casting operation. There is a need for imaging supports that can be manufactured in a single in-line manufacturing process while still meeting the stringent features and quality requirements of imaging bases.

It is also well known in the art that traditional imaging bases consist of raw paper base. For example, in typical photographic paper as currently made, approximately 75% of the weight of the photographic paper comprises the raw paper base. Although raw paper base is typically a high modulus, low cost material, there exist significant environmental issues with the paper manufacturing process. There is a need for alternate raw materials and manufacturing processes that are more environmentally friendly. Additionally to minimize environmental impact, it is important to reduce the raw paper base content, where possible, without sacrificing the imaging base features that are valued by the customer, i.e., strength, stiffness, and surface properties of the imaging support.

An important corollary of the above is the ability to recycle photographic paper. Current photographic papers cannot be recycled because they are composites of polyethylene and raw paper base and, as such, cannot be recycled using polymer recovery processes or paper recovery processes. A photographic paper that comprises significantly higher contents of polymer lends itself to recycling using polymer recovery processes.

Existing composite color paper structures are typically subject to curl through the manufacturing, finishing, and processing operations. This curl is primarily due to internal stresses that are built into the various layers of the composite structure during manufacturing and drying operations, as well as during storage operations (core-set curl). Additionally, since the different layers of the composite structure exhibit different susceptibility to humidity, the curl of the imaging base changes as a function of the humidity of its immediate environment. There is a need for an imaging support that minimizes curl sensitivity as a function of humidity, or ideally, does not exhibit curl sensitivity.

The stringent and varied requirements of imaging media, therefore, demand a constant evolution of material and processing technology. One such technology known in the art as 'polymer foams' has previously found significant application in food and drink containers, packaging, furniture, and appliances. Polymer foams have also been referred to as cellular polymers, foamed plastic, or expanded plastic. Polymer foams are multiple phase systems comprising a solid polymer matrix that is continuous and a gas phase. For example, U.S. Pat. No. 4,832,775 discloses a composite foam/film structure which comprises a polystyrene foam substrate, oriented polypropylene film applied to at least one major surface of the polystyrene foam substrate, and an acrylic adhesive component securing the polypropylene film to said major surface of the polystyrene foam substrate. The foregoing composite foam/film structure can be shaped by conventional processes as thermoforming to provide numerous types of useful articles including cups, bowls, and plates, as well as cartons and containers that exhibit excellent levels of puncture, flex-crack, grease and abrasion resistance, moisture barrier properties, and resiliency.

Recently, a superior imaging support of high stiffness, excellent smoothness, high opacity, and excellent humidity curl resistance, comprising a closed cell foam core sheet and adhered thereto an upper and lower flange sheet has been disclosed in U.S. application Ser. No. 09/723,518, filed Nov. 28, 2001 by Dontula et al. Such an imaging support can be manufactured using a single in-line operation, and can be effectively recycled. However, such an imaging support can be subject to a high degree of static charge generation and accumulation during manufacturing, sensitizing, finishing and photofinishing, as compared to conventional resin-coated paper. The problem arises from the fact that unlike paper, which is inherently conductive because of its moisture and salt content, the foam based imaging support is hydrophobic and highly insulating, and, therefore, can readily become electrostatically charged. This static build-up happens because of friction with dielectric materials and triboelectrically chargeable transport means such as rollers during high speed conveyance of the support. An electrically charged support can result in static discharge through generation of sparks that poses fire hazards in the presence of flammable solvents at a typical coating site.

Conventional photographic resin-coated paper prints control static by the use of conductivity in the paper core in combination with an external antistat layer. This is achieved by the addition of salt and moisture internal within the paper base as well as a low conducting layer on the outer most backside layer. Such a means of controlling static is typically humidity dependent and can suffer from a number of problems in low humidity conditions. Such problems include static discharge, static marking of light sensitive layers, static cling that may result in print jams during conveyance as well as multiple sheet feed in other printing devices. Furthermore the addition of salt to the paper base of a resin-coated photographic print can also result in salts leeching into the processing chemistry that can cause problems by interfering with the processing of the chemical layers in a typical silver halide image layer. Furthermore the addition of salt may interfere with the ability of the paper base to resist penetration of the processing chemicals and may result in a stain on the edge of the print. With an all polymer imaging element there is no internal means of conveying or bleeding off charge and therefore a different means of controlling static and charge accumulation is necessary.

Furthermore the needs of an all synthetic print paper are different from that of a light sensitive film base negative working system and other paper based imaging systems. For instance the photographic speed for a silver halide print paper is several times lower than that of a film base system. The sensitivity of the film silver halide system is much higher than that of a slower print paper system. On the other hand the print paper products are typically manufactured at much higher speeds. This places additional and unique demands on the performance requirements for the antistat and charge control system as the photographic materials convey across rollers of varying composition at very high speed. As the web separates from the roller surface, residual charge accumulation builds up and may cause a static discharge as it reaches a threshold level. In traditional paper products, the conductivity is provided by a salt compound but as the paper is processed some of the salt is leeched from the external antistat and the conductivity is therefore reduced. Since the paper product has an internal antistat, any additional static or charge management needs are provided by the internal conductivity of the paper. In an all synthetic print paper, in which the antistatic properties are provided by an external-antistat it is important to provide static and charge management that does not substantially change after processing.

For non-light sensitive imaging elements the lack of an internal (within the core or base structure of the element) antistat or means to bleed off charge accumulation can result in an all synthetic print paper sticking to rollers and therefore causing jams and other conveyance problems as well as several sheets sticking together that can cause paper jams. In some imaging systems, the paper is heated and compressed and brought into contact with another web such as a dye donor sheet in thermal dye sublimation. This process can result in sheet to sheet separation sticking problems and therefore it is important to provide the proper static management of the webs and in particular the print web.

The management and control of charge is very complex and control of such forces is not only dependent on the imaging element manufacturing and processing systems requirements but the imaging element itself must be co-designed in order to optimize the overall performance of the system and the imaging element.

For imaging supports, particularly those containing photographic emulsion, sparking can cause additional problems, such as irregular fog patterns or static marks and degradation of image quality. The static problems have been aggravated by increase in the sensitivity of new emulsions, increase in coating machine speeds, and increase in post-coating drying efficiency. The charge generated during the coating process may accumulate during winding and unwinding operations, during transport through the coating machines and during finishing operations such as slitting and spooling.

A vast majority of antistats for photographic paper, e.g., those taught in U.S. Pat. Nos. 5,244,728, 5,683,862, 5,955,190, and 6,171,769, are usually not "process-surviving", meaning that they lose their conductivity after wet chemical processing. This may be acceptable for normal photographic paper for any subsequent use, since the paper core provides a conductive means for charge dissipation. However, for imaging supports comprising a foam core, such antistats, which are not process-surviving, may lead to difficulties related to print sticking and dirt attraction, in a low humidity ambient.

Therefore, a careful control of the electrostatic characteristic of the imaging support is a crucial issue, particularly for those comprising a highly insulating foam core. In addition, the conductive means adopted for static control of these foam based imaging supports must satisfy all the requirement of conventional color paper products, including conveyance without dusting or track off, backmark retention, and spliceability.

PROBLEM TO BE SOLVED BY THE INVENTION

There is a need for a composite material that can be manufactured in a single in-line operation and that meets all the requirements of an imaging base.

There is also a need for an imaging base that reduces the amount of raw paper base that is used.

There is also a need for an imaging base that can be effectively recycled.

There is also a need for an imaging base that resists the tendency to curl as a function of ambient humidity.

There is also a need for static control for successful manufacture, sensitizing, finishing, photofinishing and end use of such a base.

SUMMARY OF THE INVENTION

It is an object of the invention to provide a composite imaging material that overcomes the disadvantages of prior imaging base.

It is a further object of this invention to provide a composite imaging material that resists humidity curl.

It is another object to provide an imaging member that can be manufactured in-line in a single operation.

It is another further object to provide an imaging member that can be recycled.

It is an even further object to provide such an imaging member with an electrically conductive means to achieve superior electrostatic performance of the imaging base.

These and other objects of the invention are accomplished by an imaging member comprising at least one imaging layer, a base wherein said base comprises a closed cell foam core sheet and an upper and a lower flange sheet adhered thereto, wherein said imaging member has a stiffness of between 50 and 250 millinewtons, and is conductive. The invention also provides a method of forming a conducting imaging member comprising supplying a base wherein said conductive base comprises a closed cell foam core sheet having a thickness of between 25 and 175 $\mu$m, adhering a flange material to each side of said foam core sheet, and adding at least one imaging layer, wherein said imaging member has a stiffness of between 50 and 250 millinewtons.

ADVANTAGEOUS EFFECT OF THE INVENTION

This invention provides a superior imaging support. Specifically, it provides an imaging support of high stiffness, excellent smoothness, high opacity, and excellent humidity curl resistance. It also provides an imaging support that can be manufactured using a single in-line operation. It also provides an imaging support that can be effectively recycled. Additionally, the imaging member is rendered electrically conductive by incorporating a conductive means. Moreover, such an imaging member fulfills other requirement for successful manufacture, sensitizing, finishing, photofinishing and end use.

DETAILED DESCRIPTION OF THE INVENTION

This invention has numerous advantages. The invention produces an element that has much less tendency to curl when exposed to extremes in humidity. The element can be manufactured in a single in-line operation. This significantly lowers element manufacturing costs and would eliminate disadvantages in the manufacturing of the current generation of imaging supports including very tight moisture specifications in the raw base and specifications to minimize pits during resin coating. It is an objective of this invention to use foam at the core of the imaging base, with flange layers with higher modulus that provide the needed stiffness surrounding the foam core on either side. Using this approach, many new features of the imaging base may be exploited and restrictions in manufacturing eliminated. An additional advantage of this invention is achieved through the incorporation of a conductive means, which renders the element electrically conductive for static control. Such an electrically conductive element allows for higher speed in manufacturing, sensitizing and finishing without the risk of premature fogging. When endowed with a process-surviving conductive means as per the invention, such an element ensures ease of handling, manipulation and end-use without print-sticking and dirt accumulation. These and other advantages will be apparent from the detailed description below.

The imaging member of the invention comprises a polymer foam core that has adhered thereto an upper and a lower flange sheet. The polymer foams of this core are true foams, and have also been referred to as cellular polymers, foamed plastic, or expanded plastic. Polymer foams are multiple phase systems comprising a solid polymer matrix that is continuous and a gas phase. These foams are not synonymous with voided polymers or voided polymer layers, which are created through the addition of an incompatible phase or void-initiating particle to a polymer matrix, followed by orientation in which voids are created in the matrix polymer as it is stretched around the void-initiating particles, leaving the void-initiating particles to remain in the voids of the finished sheet.

The polymer foam core of the present invention comprises a homopolymer such as a polyolefin, polystyrene, polyvinylchloride or other typical thermoplastic polymers, their copolymers or their blends thereof, or other polymeric systems like polyurethanes, polyisocyanurates that has been expanded through the use of a blowing agent to consist of two phases, a solid polymer matrix, and a gaseous phase. Other solid phases may be present in the foams in the form of fillers that are of organic (polymeric, fibrous) or inorganic (glass, ceramic, metal) origin. The fillers may be used for physical, optical (lightness, whiteness, and opacity), chemical, or processing property enhancements of the foam.

The foaming of these polymers may be carried out through several mechanical, chemical, or physical means. Mechanical methods include whipping a gas into a polymer melt, solution, or suspension, which then hardens either by catalytic action or heat or both, thus entrapping the gas bubbles in the matrix. Chemical methods include such techniques as the thermal decomposition of chemical blowing agents generating gases such as nitrogen or carbon dioxide by the application of heat or through exothermic heat of reaction during polymerization. Physical methods include such techniques as the expansion of a gas dissolved in a polymer mass upon reduction of system pressure, the volatilization of low-boiling liquids such as fluorocarbons or methylene chloride, or the incorporation of hollow microspheres in a polymer matrix. The choice of foaming technique is dictated by desired foam density reduction, desired properties, and manufacturing process.

In a preferred embodiment of this invention polyolefins such as polyethylene and polypropylene, their blends and their copolymers are used as the matrix polymer in the foam core along with a chemical blowing agent such as sodium bicarbonate and its mixture with citric acid, organic acid salts, azodicarbonamide, azobisformamide, azobisisobutyrolnitrile, diazoaminobenzene, 4,4'-oxybis (benzene sulfonyl hydrazide) (OBSH), N,N'-dinitrosopentamethyltetramine (DNPA), sodium borohydride, and other blowing agent agents well known in the art. The preferred chemical blowing agents would be sodium bicarbonate/citric acid mixtures, azodicarbonamide, though others can also be used. These foaming agents may be used together with an auxiliary foaming agent, nucleating agent, and a cross-linking agent.

The flange sheets of this invention are chosen to satisfy specific requirements of flexural modulus, caliper, surface roughness, and optical properties such as colorimetry and opacity. The flange members may be formed integral with the foam core by manufacturing the foam core with a flange skin sheet or the flange may be laminated to the foam core material. The integral extrusion of flange members with the core is preferred for cost. The lamination technique allows a wider range of properties and materials to be used for the skin materials. Imaging elements are constrained to a range in stiffness and caliper. At stiffness below a certain minimum stiffness, there is a problem with the element in print stackability and print conveyance during transport through photofinishing equipment, particularly high speed photoprocessors. It is believed that there is a minimum cross direction stiffness of 60 mN required for effective transport through photofinishing equipment. At stiffness above a certain maximum, there is a problem with the element in cutting, punching, slitting, and chopping during transport through photofinishing equipment. It is believed that there is a maximum machine direction stiffness of 300 mN for effective transport through photofinishing equipment. It is also important for the same transport reasons through photofinishing equipment that the caliper of the imaging element be constrained between 75 μm and 350 μm.

Imaging elements are typically constrained by consumer performance and present processing machine restrictions to a stiffness range of between approximately 50 mN and 250 mN and a caliper range of between approximately 100 μm and 400 μm. In the design of the element of the invention, there exists a relationship between stiffness of the imaging element and the caliper and modulus of the foam core and modulus of the flange sheets, i.e., for a given core thickness, the stiffness of the element can be altered by changing the caliper of the flange elements and/or changing the modulus of the flange elements and/or changing the modulus of the foam core.

If the target overall stiffness and caliper of the imaging element are specified then for a given core thickness and core material, the target caliper and modulus of the flange elements are implicitly constrained. Conversely, given a target stiffness and caliper of the imaging element for a given caliper and modulus of the flange sheets, the core thickness and core modulus are implicitly constrained.

Preferred ranges of foam core caliper and modulus and flange caliper and modulus follow: the preferred caliper of the foam core of the invention ranges between 200 μm and 350 μm, the caliper of the flange sheets of the invention ranges between 10 μm and 175 μm, the modulus of the foam core of the invention ranges between 30 MPa and 1000 MPa, and the modulus of the flange sheets of the invention ranges from 700 MPa to 10500 MPa. In each case, the above range is preferred because of (a) consumer preference, (b) manufacturability, and (c) materials selection. It is noted that the final choice of flange and core materials, modulus, and caliper will be a subject of the target overall element stiffness and caliper.

The selection of core material, the extent of density reduction (foaming), and the use of any additives/treatments for, e.g., cross-linking the foam, determine the foam core modulus. The selection of flange materials and treatments (for example, the addition of strength agents for paper base or the use of filler materials for polymeric flange materials) determines the flange modulus. In the preferred embodiment, the modulus of the foam core will be lower than the modulus of the flange layer or layers.

For example, at the low end of target stiffness (50 mN) and caliper (100 μm), given a typical polyolefin foam of caliper 50 μm and modulus 137.9 MPa, the flange sheet caliper is then constrained to 25 μm on each side of the core, and the flange modulus required is 10343 MPa. Also, for example, at the high end of target stiffness (250 mN) and caliper (400 μm), given a typical polyolefin foam of caliper 300 μm and modulus 137.9 MPa, the flange sheet caliper is constrained to 50 μm on each side and the flange modulus required is 1034 MPa, properties that can be met using a polyolefin flange sheet.

In a preferred lamination embodiment of this invention, the flange sheets used comprise paper. The paper of this invention can be made on a standard continuous fourdrinier wire machine or on other modern paper formers. Any pulps known in the art to provide paper may be used in this invention. Bleached hardwood chemical kraft pulp is preferred, as it provides brightness, a good starting surface, and good formation while maintaining strength. Paper flange sheets useful to this invention are of caliper between about 25 μm and about 100 μm, preferably between about 30 μm and about 70 μm because then the overall element thickness is in the range preferred by customers for imaging element and processes in existing equipment. They must be "smooth" as to not interfere with the viewing of images. Chemical additives to impart hydrophobicity (sizing), wet strength, and dry strength may be used as needed. Inorganic filler materials such as $TiO_2$, talc, and $CaCO_3$ clays may be used to enhance optical properties and reduce cost as needed. Dyes, biocides, and processing chemicals may also be used as needed. The paper may also be subject to smoothing operations such as dry or wet calendering, as well as to coating through an in-line or an off-line paper coater.

In another preferred lamination embodiment of this invention, the flange sheets used comprise high modulus polymers, preferably having a modulus between 700 MPa to 10500 Mpa, such as high density polyethylene, polypropylene, or polystyrene, their blends or their copolymers, that have been stretched and oriented. They may be filled with suitable filler materials as to increase the modulus of the polymer, preferably to the modulus range between 700 MPa to 10500 Mpa, and enhance other properties such as opacity and smoothness. Some of the commonly used inorganic filler materials are talc, clays, calcium carbonate, magnesium carbonate, barium sulfate, mica, aluminum hydroxide (trihydrate), wollastonite, glass fibers and spheres, silica, various silicates, and carbon black. Some of the organic fillers used are wood flour, jute fibers, sisal fibers, polyester fibers, and the like. The preferred fillers are talc, mica, and calcium carbonate because they provide excellent modulus enhancing properties. Polymer flange sheets useful to this invention are of caliper between about 10 μm and about 150 μm, preferably between about 35 μm and about 70 μm.

Manufacturing Process

The elements of the invention can be made using several different manufacturing methods. The coextrusion, quenching, orienting, and heat setting of the element may be effected by any process which is known in the art for producing oriented sheet, such as by a flat sheet process or a bubble or tubular process. The flat sheet process involves extruding the blend through a slit die and rapidly quenching the extruded web upon a chilled casting drum so that the foam core component of the element and the polymeric integral flange components are quenched below their glass solidification temperature. The flange components may be extruded through a multiple stream die with the outer flange forming polymer streams not containing foaming agent, Alternatively, the surface of the foaming agent containing polymer may be cooled to prevent surface foaming and form a flange. The quenched sheet is then biaxially oriented by stretching in mutually perpendicular directions at a temperature above the glass transition temperature and below the melting temperature of the matrix polymers. The sheet may be stretched in one direction and then in a second direction or may be simultaneously stretched in both directions. After the sheet has been stretched, it is heat set by heating to a temperature sufficient to crystallize or anneal the polymers while restraining, to some degree, the sheet against retraction in both directions of stretching.

The element, while described as having preferably at least three layers of a foam core and a flange layer on each side, may also be provided with additional layers that may serve to change the properties of the element. Imaging elements could be formed with surface layers that would provide an improved adhesion or look.

These elements may be coated or treated after the coextrusion and orienting process or between casting and full orientation with any number of coatings which may be used to improve the properties of the sheets including printability, to provide a vapor barrier, to make them heat sealable, or to improve the adhesion to the support or to the photosensitive layers. Examples of this would be acrylic coatings for printability, coating polyvinylidene chloride for heat seal properties. Further examples include flame, plasma, or corona discharge treatment to improve printability or adhesion.

The element may also be made through the extrusion laminating process. Extrusion laminating is carried out by bringing together the paper or polymeric flange sheets of the invention and the foam core with application of an adhesive between them, followed by their being pressed in a nip such as between two rollers. The adhesive may be applied to either the flange sheets or the foam core prior to their being brought into the nip. In a preferred form, the adhesive is applied into the nip simultaneously with the flange sheets and the foam core. The adhesive may be any suitable material that does not have a harmful effect upon the element. A preferred material is polyethylene that is melted at the time it is placed into the nip between the foam core and the flange sheet. Addenda may also be added to the adhesive layer. Any known material used in the art to improve the optical performance of the system may be used. The use of $TiO_2$ is preferred. During the lamination process also, it is desirable to maintain control of the tension of the flange sheets in order to minimize curl in the resulting laminated receiver support.

Specifications for the foam core may include the suitable range in caliper of the foam core of from 25 μm to 350 μm. The preferred caliper range is between 50 μm and 200 μm because of the preferred overall caliper range of the element which lies between 100 μm and 400 μm. The range in density reduction of the foam core is from 20% to 95%. The preferred range in density reduction is between 40% and 70%. This is because it is difficult to manufacture a uniform product with very high density reduction (over 70%). Density reduction is the percent difference between solid polymer and a particular foam sample. It is also not economical to manufacture a product with density reduction less than 40%.

In another embodiment of this invention, the flange sheets used comprise paper on one side and a high modulus polymeric material on the other side. In another embodiment, an integral skin may be on one side and another skin laminated to the other side of the foam core. The caliper of the paper and of the high modulus polymeric material is determined by the respective flexural modulus such that the overall stiffness of the imaging element lies within the preferred range, and the bending moment around the central axis is balanced to prevent excessive curl.

In addition to the stiffness and caliper, an imaging element needs to meet constraints in surface smoothness and optical properties such as opacity and colorimetry. Surface smoothness characteristics may be met during flange-sheet manufacturing operations such as during paper making or during the manufacture of oriented polymers like oriented polystyrene. Alternatively, it may be met by extrusion coating additional layer(s) of polymers such as polyethylene onto the flange sheets in contact with a textured chill-roll or similar technique known by those skilled in the art. Optical properties such as opacity and colorimetry may be met by the appropriate use of filler materials such as titanium dioxide and calcium carbonate and colorants, dyes and/or optical brighteners or other additives known to those skilled in the art. Opacity can be measured according to ASTM method E308-96. It is preferred that the base has opacity between 80% and 99%, as per this test method. The fillers, such as polyethylene, may be in the flange or an overcoat layer, or surface overcoat (SOC) layer. Generally, base materials for color print imaging materials are white, possibly with a blue tint as a slight blue is preferred to form a preferred white look to whites in an image. Any suitable white pigment may be incorporated in the polyolefin layer such as, for example, titanium dioxide, zinc oxide, zinc sulfide, zirconium dioxide, white lead, lead sulfate, lead chloride, lead aluminate, lead phthalate, antimony trioxide, white bismuth, tin oxide, white manganese, white tungsten, and combinations thereof. The pigment is used in any form that is conveniently dispersed within the flange or resin coat layers. The preferred pigment is titanium dioxide. In addition, suitable optical brightener may be employed in the polyolefin layer including those described in *Research Disclosure*, Vol. No. 308, December 1989, Publication 308119, Paragraph V, page 998.

In addition, it may be desirable to use various additives such as antioxidants, slip agents, or lubricants, and light stabilizers in the plastic elements as well as biocides in the paper elements. These additives are added to improve, among other things, the dispersibility of fillers and/or colorants, as well as the thermal and color stability during processing and the manufacturability and the longevity of the finished article. For example, the polyolefin coating may contain antioxidants such as 4,4'-butylidene-bis(6-tert-butyl-meta-cresol), di-lauryl-3,3'-thiopropionate, N-butylated-p-aminophenol, 2,6-di-tert-butyl-p-cresol, 2,2-di-tert-butyl-4-methyl-phenol, N,N-disalicylidene-1,2-diaminopropane, tetra(2,4-tert-butylphenyl)-4,4'-diphenyl diphosphonite, octadecyl 3-(3',5'-di-tert-butyl-4'-hydroxyphenyl propionate), combinations of the above, and the like, heat stabilizers, such as higher aliphatic acid metal salts such as magnesium stearate, calcium stearate, zinc stearate, aluminum stearate, calcium palmitate, zirconium octylate, sodium laurate, and salts of benzoic acid such as sodium benzoate, calcium benzoate, magnesium benzoate and zinc benzoate, light stabilizers such as hindered amine light stabilizers (HALS), of which a preferred example is poly {[6-[(1,1,3,3-tetramethylbutylamino}-1,3,5-triazine-4-piperidinyl)-imino]-1,6-hexanediyl[{2,2,6,6-tetramethyl-4-piperdinyl) imino]}(Chimassorb® 944 LD/FL).

The conductive means as per the invention can be achieved through the incorporation of any electrically conductive material in the imaging element. The conductive means containing layer is also known as an antistatic layer. Electrically conductive materials can be divided into two broad groups: (i) ionic conductors and (ii) electronic conductors. In ionic conductors charge is transferred by the bulk diffusion of charged species through an electrolyte. Here the resistivity is dependent on temperature and humidity. Although relatively inexpensive, many of the ionic conductors are water-soluble and are leached out of the antistatic layer during processing, resulting in a loss of antistatic function. The conductivity of an electronic conductor depends on electronic mobility rather than ionic mobility and is independent of humidity. Although usually process-surviving, electronically conducting materials can be expensive and may impart unfavorable physical characteristics, such as color, increased brittleness and poor adhesion.

Electronic conductors such as conjugated conducting polymers, conducting carbon particles, crystalline semiconductor particles, amorphous semiconductive fibrils, and continuous conductive metal or semiconducting thin films can be used in this invention to afford humidity independent, process-surviving antistatic protection. Of the various types of electronic conductors, electronically conductive metal-containing particles, such as semiconducting metal oxides, and electronically conductive polymers, such as, substituted or unsubstituted polythiophenes, substituted or unsubstituted polypyrroles, and substituted or unsubstituted polyanilines are particularly effective for the present invention.

Conductive metal-containing particles, which may be used in the present invention include conductive crystalline inorganic oxides, conductive metal antimonates, and conductive inorganic non-oxides. Crystalline inorganic oxides may be chosen from zinc oxide, titania, tin oxide, alumina, indium oxide, silica, magnesia, barium oxide, molybdenum oxide, tungsten oxide, and vanadium oxide or composite oxides thereof, as described in, e.g., U.S. Pat. Nos. 4,275,103, 4,394,441, 4,416,963, 4,418,141, 4,431,764, 4,495,276, 4,571,361, 4,999,276 and 5,122,445. The conductive crystalline inorganic oxides may contain a "dopant" in the range from 0.01 to 30 mole percent, preferred dopants being aluminum or indium for zinc oxide, niobium or tantalum for titania, and antimony, niobium or halogens for tin oxide. Alternatively, the conductivity can be enhanced by formation of oxygen defects by methods well known in the art. The use of antimony-doped tin oxide at an antimony doping level of at least 8 atom percent and having an X-ray crystallite size less than 100 Å and an average equivalent spherical diameter less than 15 nm but no less than the X-ray crystallite size as taught in U.S. Pat. No. 5,484,694 is specifically contemplated.

Particularly useful electronically conductive metal-containing particles, which may be used in the antistatic layer, include acicular doped metal oxides, acicular metal oxide particles, acicular metal oxides containing oxygen deficiencies. In this category, acicular doped tin oxide particles, particularly acicular antimony-doped tin oxide particles, acicular niobium-doped titanium dioxide particles, and the like are preferred because of their availability. The aforesaid acicular conductive particles preferably have a cross-sectional diameter less than or equal to 0.02 $\mu$m and an aspect ratio greater than or equal to 5:1. Some of these acicular conductive particles; useful for the present invention, are described in U.S. Pat Nos. 5,719,016, 5,731,119, 5,939,243 and references therein.

If used, the volume fraction of the acicular electronically conductive metal oxide particles in the dried antistatic layer of the invention can vary from 1 to 70% and preferably from 5 to 50% for optimum physical properties. For non-acicular electronically conductive metal oxide particles, the volume fraction can vary from 15 to 90%, and preferably from 20 to 80% for optimum properties.

The invention is also applicable where the conductive agent comprises a conductive "amorphous" gel such as vanadium oxide gel comprised of vanadium oxide ribbons or fibers. Such vanadium oxide gels may be prepared by any variety of methods, including but not specifically limited to melt quenching as described in U.S. Pat. No. 4,203,769, ion exchange as described in DE 4,125,758, or hydrolysis of a vanadium oxoalkoxide as claimed in WO 93/24584. The vanadium oxide gel is preferably doped with silver to enhance conductivity. Other methods of preparing vanadium oxide gels which are well known in the literature include reaction of vanadium or vanadium pentoxide with hydrogen peroxide and hydrolysis of $VO_2$ OAc or vanadium oxychloride.

Conductive metal antimonates suitable for use in accordance with the invention include those as disclosed in, U.S. Pat. Nos. 5,368,995 and 5,457,013, for example. Preferred conductive metal antimonates have a rutile or rutile-related crystallographic structures and may be represented as $M^{+2}Sb^{+5}{}_2O_6$ (where $M^{+2}$=$Zn^{+2}$, $Ni^{+2}$, $Mg^{+2}$, $Fe^{+2}$, $Cu^{+2}$, $Mn^{+2}$, $Co^{+2}$) or $M^{+3}Sb^{+5}O_4$(where $M^{+3}$=$In^{+3}$, $Al^{+3}$, $Sc^{+3}$, $Cr^{+3}$, $Fe^{+3}$). Several colloidal conductive metal antimonate dispersions are commercially available from Nissan Chemical Company in the form of aqueous or organic dispersions. Alternatively, U.S. Pat. Nos. 4,169,104 and 4,110,247 teach a method for preparing $M^{+2}Sb^{+5}{}_2O_6$ by treating an aqueous solution of potassium antimonate with an aqueous solution of an appropriate metal salt (e.g., chloride, nitrate, sulfate) to form a gelatinous precipitate of the corresponding insoluble hydrate which may be converted to a conductive metal antimonate by suitable treatment. If used, the volume fraction of the conductive metal antimonates in the dried antistatic layer can vary from 15 to 90%. But it is preferred to be between 20 to 80% for optimum physical properties.

Conductive inorganic non-oxides suitable for use as conductive particles in the present invention include metal nitrides, metal borides and metal silicides, which may be acicular or non-acicular in shape. Examples of these inorganic non-oxides include titanium nitride, titanium boride, titanium carbide, niobium boride, tungsten carbide, lanthanum boride, zirconium boride, molybdenum boride and the like. Examples of conductive carbon particles, include carbon black and carbon fibrils or nanotubes with single walled or multi-walled morphology. Example of such suitable conductive carbon particles can be found in U.S. Pat. No. 5,576,162 and references therein.

Suitable electrically conductive polymers that are preferred for incorporation in the antistatic layer of the invention are specifically electronically conducting polymers, such as those illustrated in U.S. Pat. Nos. 6,025,119, 6,060,229, 6,077,655, 6,096,491, 6,124,083, 6,162,596, 6,187,522, and 6,190,846. These electronically conductive polymers include substituted or unsubstituted aniline-containing polymers (as disclosed in U.S. Pat. Nos. 5,716,550, 5,093,439 and 4,070,189), substituted or unsubstituted thiophene-containing polymers (as disclosed in U.S. Pat. Nos. 5,300,575, 5,312,681, 5,354,613, 5,370,981, 5,372,924, 5,391,472, 5,403,467, 5,443,944, 5,575,898, 4,987,042 and 4,731,408), substituted or unsubstituted pyrrole-containing polymers (as disclosed in U.S. Pat. Nos. 5,665,498 and 5,674,654), and poly(isothianaphthene) or derivatives thereof. These conducting polymers may be soluble or dispersible in organic solvents or water or mixtures thereof. Preferred conducting polymers for the present invention include polypyrrole styrene sulfonate (referred to as polypyrrole/poly (styrene sulfonic acid) in U.S. Pat. No. 5,674,654), 3,4-dialkoxy substituted polypyrrole styrene sulfonate, and 3,4-dialkoxy substituted polythiophene styrene sulfonate because of their color. The most preferred substituted electronically conductive polymers include poly(3,4-ethylene dioxythiophene styrene sulfonate), such as Baytron® P supplied by Bayer Corporation, for its apparent availability in relatively large quantity. The weight % of the conductive polymer in the dried antistatic layer of the invention can vary from 1 to 99% but preferably varies from 2 to 30% for optimum physical properties.

Although, humidity dependent, ionic conductors are traditionally more cost-effective than electronic conductors and find widespread use in reflective imaging media such as paper. Any such ionic conductor can be incorporated in the antistatic layer of the invention. The ionic conductors can comprise inorganic and/or organic salt. Alkali metal salts particularly those of polyacids are effective. The alkali metal can comprise lithium, sodium or potassium and the polyacid can comprise polyacrylic or polymethacrylic acid, maleic acid, itaconic acid, crotonic acid, polysulfonic acid or mixed polymers of these compounds, as well as cellulose derivatives. The alkali salts of polystyrene sulfonic acid, napthalene sulfonic acid or an alkali cellulose sulfate are preferred for their performance.

The combination of polymerized alkylene oxides and alkali metal salts, described in U.S. Pat. Nos. 4,542,095 and 5,683,862 incorporated herein by reference, is also a preferred choice. Specifically, a combination of a polyethylene ether glycol and lithium nitrate is a desirable choice because of its performance and cost. Also, preferred are inorganic particles such as electrically conductive synthetic or natural smectite clay. Of particular preference:for application in the present invention are those ionic conductors, which are disclosed in U.S. Pat. Nos. 5,683,862, 5,869,227, 5,891,611, 5,981,126, 6,077,656, 6,120,979, 6,171,769, and references therein.

Surfactants capable of static dissipation are also suitable for application in the present invention. Such surfactants are usually highly polar compounds and can be anionic, cationic or non-ionic or mixtures thereof, as described in U.S. Pat. No. 6,136,396 herein incorporated by reference. Examples of anionic surfactants include compounds such as those comprising alkyl sulfates, alkyl sulfonates and alkyl phosphates having alkyl chains of 4 or more carbon atoms in length. Examples of cationic surfactants include compounds such as onium salts, particularly quaternary ammonium or phosphonium salts, having alkyl chains of 4 or more carbon atoms in length. Examples of non-ionic surfactants include compounds such as polyvinyl alcohol, polyvinylpyrrolidone and polyethers, as well as amines, acids and fatty acid esters having alkyl groups of 4 or more carbon atoms in length. Surfactants can also be effectively used for charge balancing, as per the present invention. In this case, suitable surfactants are chosen to counter balance the tribocharge generated on the surface.

Besides the conductive agent, the antistatic layer of the invention is preferred to comprise a suitable polymeric binder to achieve physical properties such as adhesion, abrasion resistance, backmark retention and others. The polymeric binder can be any polymer depending on the specific need. The binder polymer can be one or more of a water soluble polymer, a hydrophilic colloid or a water insoluble polymer, latex or dispersion. Particular preference is given to polymers selected from the group of polymers and interpolymers prepared from ethylenically unsaturated monomers such as styrene, styrene derivatives, acrylic acid or methacrylic acid and their derivatives, olefins, chlorinated olefins, (meth)acrylonitriles, itaconic acid and its derivatives, maleic acid and its derivatives, vinyl halides, vinylidene halides, vinyl monomer having a primary amine addition salt, vinyl monomer containing an aminostyrene addition salt and others. Also included are polymers such as polyurethanes and polyesters. Particularly preferred binder polymers are those disclosed in U.S. Pat. Nos. 6,171,769, 6,120,979 and 6,077,656, because of their excellent adhesion characteristics.

The conductive particles that can be incorporated in the antistatic layer are not specifically limited in particle size or shape. The particle shape may range from roughly spherical or equiaxed particles to high aspect ratio particles such as fibers, whiskers, tubes, platelets or ribbons. Additionally, the conductive materials described above may be coated on a variety of other particles, also not particularly limited in shape or composition. For example the conductive inorganic material may be coated on non-conductive silica, alumina, titania and mica particles, whiskers or fibers.

The antistatic layer of the invention is preferred to comprise a colloidal sol, which may or may not be electrically conductive, to improve physical properties such as durability, roughness, coefficient of friction, as well as to reduce cost. The colloidal sol utilized in the present invention comprises finely divided inorganic particles in a liquid medium, preferably water. Most preferably the inorganic particles are metal oxide based. Such metal oxides include tin oxide, titania, antimony oxide, zirconia, ceria, yttria, zirconium silicate, silica, alumina, such as boehmite, aluminum modified silica, as well as other inorganic metal oxides of Group III and IV of the Periodic Table and mixtures thereof. The selection of the inorganic metal oxide sol is dependent on the ultimate balance of properties desired as well as cost. Inorganic particles such as silicon carbide, silicon nitride and magnesium fluoride when in sol form are also useful for the present invention. The inorganic particles of the sol have an average particle size less than 100 nm, preferably less than 70 nm and most preferably less than 40 nm. A variety of colloidal sols useful in the present invention are commercially available from DuPont, Nalco Chemical Co., and Nyacol Products Inc.

The weight % of the inorganic particles of the aforesaid sol are preferred to be at least 5% and more preferred to be at least 10% of the dried antistatic layer of the invention to achieve the desired physical properties.

In one embodiment, the antistatic layer is formed from a coating composition, which can be aqueous or non-aqueous, by any of the well known coating methods. For environmental reasons, aqueous coatings are preferred. The coating methods may include but not limited to hopper coating, rod coating, gravure coating, roller coating, spray coating, and the like. The surface on which the coating composition is deposited for forming the antistatic layer can be treated for improved adhesion by any of the means known in the art, such as acid etching, flame treatment, corona discharge treatment, glow discharge treatment or can be coated with a suitable primer layer. However, corona discharge treatment is the preferred means for adhesion promotion.

In an alternate embodiment, the antistatic layer can be formed by thermal processing such as extrusion, co-extrusion, with or without orientation, injection molding, blow molding, lamination, and the like. If thermal processing is involved, it is preferred that the conductive material is thermally processable. Any of the melt-processable conductive polymeric materials disclosed in U.S. Pat. Nos. 6,197,486, 6,207,361 and U.S. application Ser. Nos. 09/853,846 filed May 11, 2001 by Majumdar et al., now allowed, 09/853,905 filed May 11, 2001 by Majumdar et al., and 09/853,515 filed May 11, 2001 by Majumdar et al. are preferred for these applications. Such polymeric materials include those containing polyether groups, such as polyether-block-polyamide, polyetheresteramide, polyurethanes containing polyalkylene glycol moiety, with or without thermally processable onium salts. Substituted or un-substituted polyanilines are also suitable for this purpose. It is preferred that the melt-processable conductive material is combined with one or more matrix polymer and compatibilizer known in the art to achieve desirable physical properties.

The antistatic layer of the invention can comprise any number of addenda for any specific reason. These addenda can include tooth-providing ingredients (vide U.S. Pat. No. 5,405,907, for example), surfactants, defoamers or coating aids, charge control agents, thickeners or viscosity modifiers, coalescing aids, crosslinking agents or hardeners, soluble and/or solid particle dyes, antifoggants, fillers, matte beads, inorganic or polymeric particles, adhesion promoting agents, bite solvents or chemical etchants, lubricants, plasticizers, antioxidants, voiding agents, colorants or tints, roughening agents, slip agent, and others well-known in the art.

The antistatic layer of the invention can be placed anywhere in the imaging element, i.e., on the top side, or the bottom side, or both sides. The aforementioned top side refers to the image receiving side whereas the bottom side refers to the opposite side of the imaging support. Similarly, the "upper flange" refers to the flange closest to the image receiving layer and the "lower flange" refers to the flange farthest from the image receiving layer. Specifically, the antistatic layer can be placed over the upper flange and/or over the lower flange, and/or between the closed cell foam core and any of the flanges. If the flanges are provided with a skin layer, the antistatic layer can be placed over the skin layer and/or under the skin layer. Alternatively, the closed cell foam core and/or any of the flanges themselves can be rendered antistatic, through the incorporation of any of the conductive materials described herein above, into the body of the closed cell foam core and/or the flange(s). In yet another embodiment, the antistatic layer can be placed in any of the image receiving layers, between image receiving layers, i.e., as an interlayer, under any image receiving layer, i.e., as an undercoat, over an image receiving layer, i.e., as an external layer or overcoat, or any combinations thereof. In a preferred embodiment, the antistat layer is placed as a bottom-most external layer over the lower flange of the imaging element.

For adequate static protection, the antistatic layer of the invention needs to have a surface electrical resistivity or internal electrical resistivity of less than 13 log ohms/ square, preferably less than 12 log ohms/ square, more preferably less than 11 log ohms/ square, and most preferably less than 10 log ohms/ square.

Used herein, the phrase 'imaging element' comprises an imaging support as described-above along with an image receiving layer as applicable to multiple techniques governing the transfer of an image onto the imaging element. Such techniques include thermal dye transfer, electrophotographic printing, or ink jet printing, as well as a support for photographic silver halide images. As used herein, the phrase "photographic element" is a material that utilizes photosensitive silver halide in the formation of images.

The thermal dye image-receiving layer of the receiving elements of the invention may comprise, for example, a polycarbonate, a polyurethane, a polyester, polyvinyl chloride, poly(styrene-co-acrylonitrile), poly(caprolactone), or mixtures thereof. The dye image-receiving layer may be present in any amount that is effective for the intended purpose. In general, good results have been obtained at a concentration of from about 1 to about 10 $g/m^2$. An overcoat layer may be further coated over the dye-receiving layer, such as described in U.S. Pat. No. 4,775,657 of Harrison et al.

Dye-donor elements that are used with the dye-receiving element of the invention conventionally comprise a support having thereon a dye containing layer. Any dye can be used in the dye-donor employed in the invention, provided it is transferable to the dye-receiving layer by the action of heat. Especially good results have been obtained with sublimable dyes. Dye donors applicable for use in the present invention are described, e.g., in U.S. Pat. Nos. 4,916,112, 4,927,803, and 5,023,228. As noted above, dye-donor elements are used to form a dye transfer image. Such a process comprises image-wise-heating a dye-donor element and transferring a dye image to a dye-receiving element as described above to form the dye transfer image. In a preferred embodiment of the thermal dye transfer method of printing, a dye donor element is employed which compromises a poly(ethylene terephthalate) support coated with sequential repeating areas of cyan, magenta, and yellow dye, and the dye transfer steps are sequentially performed for each color to obtain a three-color dye transfer image. When the process is only performed for a single color, then a monochrome dye transfer image is obtained.

Thermal printing heads which can be used to transfer dye from dye-donor elements to receiving elements of the invention are available commercially. There can be employed, for example, a Fujitsu Thermal Head (FTP-040 MCS001), a TDK Thermal Head F415 HH7-1089, or a Rohm Thermal Head KE 2008-F3. Alternatively, other known sources of energy for thermal dye transfer may be used, such as lasers as described in, for example, GB No. 2,083,726A.

A thermal dye transfer assemblage of the invention comprises (a) a dye-donor element, and (b) a dye-receiving element as described above, the dye-receiving element being in a superposed relationship with the dye-donor element so that the dye layer of the donor element is in contact with the dye image-receiving layer of the receiving element.

When a three-color image is to be obtained, the above assemblage is formed on three occasions during the time when heat is applied by the thermal printing head. After the first dye is transferred, the elements are peeled apart. A second dye-donor element (or another area of the donor element with a different dye area) is then brought in register with the dye-receiving element and the process repeated. The third color is obtained in the same manner.

The electrographic and electrophotographic processes and their individual steps have been well described in the prior art. The processes incorporate the basic steps of creating an electrostatic image, developing that image with charged, colored particles (toner), optionally transferring the resulting developed image to a secondary substrate, and fixing the image to the substrate. There are numerous variations in these processes and basic steps. The use of liquid toners in place of dry toners is simply one of those variations.

The first basic step, creation of an electrostatic image, can be accomplished by a variety of methods. In one form, the electrophotographic process of copiers uses imagewise photodischarge, through analog or digital exposure, of a uniformly charged photoconductor. The photoconductor may be a single-use system, or it may be rechargeable and reimageable, like those based on selenium or organic photoreceptors.

In an alternate electrographic process, electrostatic images are created ionographically. The latent image is created on dielectric (charge-holding) medium, either paper or film. Voltage is applied to selected metal styli or writing nibs from an array of styli spaced across the width of the medium, causing a dielectric breakdown of the air between the selected styli and the medium. Ions are created, which form the latent image on the medium.

Electrostatic images, however generated, are developed with oppositely charged toner particles. For development with liquid toners, the liquid developer is brought into direct contact with the electrostatic image. Usually a flowing liquid is employed to ensure that sufficient toner particles are available for development. The field created by the electrostatic image causes the charged particles, suspended in a nonconductive liquid, to move by electrophoresis. The charge of the latent electrostatic image is thus neutralized by the oppositely charged particles. The theory and physics of electrophoretic development with liquid toners are well described in many books and publications.

If a reimageable photoreceptor or an electrographic master is used, the toned image is transferred to paper (or other substrate). The paper is charged electrostatically, with the polarity chosen to cause the toner particles to transfer to the paper. Finally, the toned image is fixed to the paper. For self-fixing toners, residual liquid is removed from the paper by air-drying or heating. Upon evaporation of the solvent, these toners form a film bonded to the paper. For heat fusible toners, thermoplastic polymers are used as part of the particle. Heating both removes residual liquid and fixes the toner to paper.

When used as ink jet imaging media, the recording elements or media typically comprise a substrate or a support material having on at least one surface thereof an ink-receiving or image-forming layer. If desired, in order to improve the adhesion of the ink receiving layer to the support, the surface of the support may be corona-discharge-treated prior to applying the solvent-absorbing layer to the support or, alternatively, an undercoating, such as a layer formed from a halogenated phenol or a partially hydrolyzed vinyl chloride-vinyl acetate copolymer, can be applied to the surface of the support. The ink receiving layer is preferably coated onto the support layer from water or water-alcohol solutions at a dry thickness ranging from 3 to 75 micrometers, preferably 8 to 50 micrometers.

Any known ink jet receiver layer can be used in combination with the present invention. For example, the ink receiving layer may consist primarily of inorganic oxide particles such as silicas, modified silicas, clays, aluminas, fusible beads such as beads comprised of thermoplastic or thermosetting polymers, non-fusible organic beads, or hydrophilic polymers such as naturally-occurring hydrophilic colloids and gums such as gelatin, albumin, guar, xantham, acacia, chitosan, starches and their derivatives, and the like, derivatives of natural polymers such as functionalized proteins, functionalized gums and starches, and cellulose ethers and their derivatives, and synthetic polymers such as polyvinyloxazoline, polyvinylmethyloxazoline, polyoxides, polyethers, poly(ethylene imine), poly(acrylic acid), poly(methacrylic acid), n-vinyl amides including polyacrylamide and polyvinylpyrrolidone, and poly(vinyl alcohol), its derivatives and copolymers, and combinations of these materials. Hydrophilic polymers, inorganic oxide particles, and organic beads may be present in one or more layers on the substrate and in various combinations within a layer.

A porous structure may be introduced into ink receiving layers comprised of hydrophilic polymers by the addition of ceramic or hard polymeric particulates, by foaming or blowing during coating, or by inducing phase separation in the layer through introduction of non-solvent. In general, it is preferred for the base layer to be hydrophilic, but not porous. This is especially true for photographic quality prints, in which porosity may cause a loss in gloss. In particular, the ink receiving layer may consist of any hydrophilic polymer or combination of polymers with or without additives as is well known in the art.

If desired, the ink receiving layer can be overcoated with an ink-permeable, anti-tack protective layer such as, for example, a layer comprising a cellulose derivative or a cationically-modified cellulose derivative or mixtures thereof. An especially preferred overcoat is poly β-1,4-anhydro-glucose-g-oxyethylene-g-(2'-hydroxypropyl)-N,N-dimethyl-N-dodecylammonium chloride. The overcoat layer is non porous, but is ink permeable and serves to improve the optical density of the images printed on the element with water-based inks. The overcoat layer can also protect the ink receiving layer from abrasion, smudging, and water damage. In general, this overcoat layer may be present at a dry thickness of about 0.1 to about 5 μm, preferably about 0.25 to about 3 μm.

In practice, various additives may be employed in the ink receiving layer and overcoat. These additives include surface active agents such as surfactant(s) to improve coatability and to adjust the surface tension of the dried coating, acid or base to control the pH, suspending agents, antioxidants, hardening agents to cross-link the coating, antioxidants, UV stabilizers, light stabilizers, and the like. In addition, a mordant may be added in small quantities (2%–10% by weight of the base layer) to improve waterfastness. Useful mordants are disclosed in U.S. Pat. No. 5,474,843.

The layers described above, including the ink receiving layer and the overcoat layer, may be coated by conventional coating means onto a transparent or opaque support material commonly used in this art. Coating methods may include, but are not limited to, blade coating, wound wire rod coating, slot coating, slide hopper coating, gravure, curtain coating, and the like. Some of these methods allow for simultaneous coatings of both layers, which is preferred from a manufacturing economic perspective.

The DRL (dye receiving layer) is coated over the tie layer (TL) at a thickness ranging from 0.1–10 μm, preferably 0.5–5 μm. There are many known formulations which may be useful as dye receiving layers. The primary requirement is that the DRL is compatible with the inks which it will be imaged so as to yield the desirable color gamut and density. As the ink drops pass through the DRL, the dyes are retained or mordanted in the DRL, while the ink solvents pass freely through the DRL and are rapidly absorbed by the TL. Additionally, the DRL formulation is preferably coated from water, exhibits adequate adhesion to the TL, and allows for easy control of the surface gloss.

For example, Misuda et al in U.S. Pat. Nos. 4,879,166, 5,264,275, 5,104,730, 4,879,166, and Japanese Patents 1,095,091, 2,276,671, 2,276,670, 4,267,180, 5,024,335, and 5,016,517 disclose aqueous based DRL formulations comprising mixtures of psuedo-bohemite and certain water soluble resins. Light in U.S. Pat. Nos. 4,903,040, 4,930,041, 5,084,338, 5,126,194, 5,126,195, and 5,147,717 discloses aqueous-based DRL formulations comprising mixtures of vinyl pyrrolidone polymers and certain water-dispersible and/or water-soluble polyesters, along with other polymers and addenda. Butters et al in U.S. Pat. Nos. 4,857,386 and 5,102,717 disclose ink-absorbent resin layers comprising mixtures of vinyl pyrrolidone polymers and acrylic or methacrylic polymers. Sato et al in U.S. Pat. No. 5,194,317 and Higuma et al in U.S. Pat. No. 5,059,983 disclose aqueous-coatable DRL formulations based on poly(vinyl alcohol). Iqbal in U.S. Pat. No. 5,208,092 discloses water-based DRL formulations comprising vinyl copolymers which are subsequently cross-linked. In addition to these examples, there may be other known or contemplated DRL formulations which are consistent with the aforementioned primary and secondary requirements of the DRL, all of which fall under the spirit and scope of the current invention.

The preferred DRL is 0.1–10 micrometers thick and is coated as an aqueous dispersion of 5 parts alumoxane and 5 parts poly(vinyl pyrrolidone). The DRL may also contain varying levels and sizes of matting agents for the purpose of controlling gloss, friction, and/or fingerprint resistance, surfactants to enhance surface uniformity and to adjust the surface tension of the dried coating, mordanting agents, antioxidants, UV absorbing compounds, light stabilizers, and the like.

Although the ink-receiving elements as described above can be successfully used to achieve the objectives of the present invention, it may be desirable to overcoat the DRL for the purpose of enhancing the durability of the imaged element. Such overcoats may be applied to the DRL either before or after the element is imaged. For example, the DRL can be overcoated with an ink-permeable layer through which inks freely pass. Layers of this type are described in U.S. Pat. Nos. 4,686,118, 5,027,131, and 5,102,717. Alternatively, an overcoat may be added after the element is imaged. Any of the known laminating films and equipment may be used for this purpose. The inks used in the aforementioned imaging process are well known, and the ink formulations are often closely tied to the specific processes, i.e., continuous, piezoelectric, or thermal. Therefore, depending on the specific ink process, the inks may contain widely differing amounts and combinations of solvents, colorants, preservatives, surfactants, humectants, and the like. Inks preferred for use in combination with the image recording elements of the present invention are water-based, such as those currently sold for use in the Hewlett-Packard Desk Writer 560C printer. However, it is intended that alternative embodiments of the image-recording elements as described above, which may be formulated for use with inks which are specific to a given ink-recording process or to a given commercial vendor, fall within the scope of the present invention.

Smooth opaque paper bases are useful in combination with silver halide images because the contrast range of the silver halide image is improved, and show through of ambient light during image viewing is reduced. The preferred photographic element of this invention is directed to a silver halide photographic element capable of excellent performance when exposed by either an electronic printing method or a conventional optical printing method. An electronic printing method comprises subjecting a radiation sensitive silver halide emulsion layer of a recording element to actinic radiation of at least $10^{-4}$ ergs/cm$^2$ for up to 100 $\mu$ seconds duration in a pixel-by-pixel mode wherein the silver halide emulsion layer is comprised of silver halide grains as described above. A conventional optical printing method comprises subjecting a radiation sensitive silver halide emulsion layer of a recording element to actinic radiation of at least $10^{-4}$ ergs/cm$^2$ for $10^{-3}$ to 300 seconds in an imagewise mode wherein the silver halide emulsion layer is comprised of silver halide grains as described above. This invention in a preferred embodiment utilizes a radiation-sensitive emulsion comprised of silver halide grains (a) containing greater than 50 mole percent chloride based on silver, (b) having greater than 50 percent of their surface area provided by {100} crystal faces, and (c) having a central portion accounting for from 95 to 99 percent of total silver and containing two dopants selected to satisfy each of the following class requirements: (i) a hexacoordination metal complex which satisfies the formula:

$$[ML_6]^n \quad \text{(I)}$$

wherein n is zero, −1, −2, −3, or −4, M is a filled frontier orbital polyvalent metal ion, other than iridium, and $L_6$ represents bridging ligands which can be independently selected, provided that at least four of the ligands are anionic ligands, and at least one of the ligands is a cyano ligand or a ligand more electronegative than a cyano ligand, and (ii) an iridium coordination complex containing a thiazole or substituted thiazole ligand. Preferred photographic imaging layer structures are described in EP Publication 1 048 977. The photosensitive imaging layers described therein provide particularly desirable images on the base of this invention.

This invention is directed towards a photographic recording element comprising a support and at least one light sensitive silver halide emulsion layer comprising silver halide grains as described above.

The following examples illustrate the practice of this invention. They are not intended to be exhaustive of all possible variations of the invention. Parts and percentages are by weight unless otherwise indicated.

EXAMPLES

Support for Antistatic Layers Coated From Aqueous Coating Compositions

Support A described herein below is used for coating aqueous antistatic compositions.

Polypropylene foam of caliper 6.0 mil and density 0.53 g/cm$^3$ was obtained from Berwick Industries, Berwick, Pa. This was then extrusion resin coated on both sides using a flat sheet die. The upper flange or the face side of the foam was coextrusion coated. The layer closer to the foam was coated at 7.5 lbs./ksf coverage, at a melt temperature of 525° F., and comprised 10% anatase $TiO_2$, 20% Mistron ® CB Talc (from Luzenac America), 20% PA609 ® (amorphous substituted cyclopentadiene organic polymer from Exxon Mobil) and 50% PF611 ® (polypropylene homopolymer—extrusion coating grade from Basell). The skin layer was coated at 2.55 lbs./ksf coverage, at a melt temperature of 575° F., and comprised 18% $TiO_2$, 4.5% ZnO, and 78.5% D4002 P ® (low density polyethylene from Eastman Chemical Company). The lower flange or the wire side of the foam was monoextrusion coated at 525° F. melt temperature. The lower flange coating was at 11.5 lbs./ksf coverage and comprised 10% anatase $TiO_2$, 20% Mistron ® CB Talc, 20% PA609 ® and 50% PF611 ®.

Aqueous Antistatic Compositions

The aqueous antistatic coating compositions used in the working examples comprise the following ingredients.

Conductive materials:

(a) Acicular antimony doped tin oxide dispersion FS 10D ® supplied by Ishihara Techno Corp or (b) Poly(3,4-ethylene dioxythiophene styrene sulfonate) Baytron P ® supplied by Bayer Corporation.

Polymeric binder:

Styrene acrylate latex Neocryl ® A5045, supplied by Avecia.

Colloidal sol

Alumina modified colloidal silica Ludox ® AM supplied by DuPont

The following samples Ex 1–13 are prepared in accordance with the invention, by coating appropriate aqueous antistatic compositions on the surface of the lower flange of the abovementioned support A, after subjecting the surface to corona discharge treatment. Sample Comp. 1 is the bare support A without any further coating, for comparison. Details about the composition of the samples are listed in Table 1A.

TABLE 1A

| | | dry antistatic layer composition over lower flange surface | | | dry antistatic |
|---|---|---|---|---|---|
| Sample | support | | Ludox ® AM wt. % | Neocryl ® wt. % | layer coverage mg/ft2 |
| | | FS 10D ® wt. % | | | |
| Ex. 1 | A | 20 | 16 | 64 | 30 |
| Ex. 2 | A | 25 | 15 | 60 | 30 |
| Ex. 3 | A | 30 | 14 | 56 | 30 |
| Ex. 4 | A | 35 | 13 | 52 | 30 |
| Ex. 5 | A | 40 | 12 | 48 | 30 |
| Ex. 6 | A | 45 | 11 | 44 | 30 |
| Ex. 7 | A | 50 | 10 | 40 | 30 |
| | | Baytron P ® wt. % | | | |
| Ex. 8 | A | 4 | 19.2 | 76.8 | 30 |
| Ex. 9 | A | 6 | 18.8 | 75.2 | 30 |
| Ex. 10 | A | 8 | 18.4 | 73.6 | 30 |
| Ex. 11 | A | 10 | 18 | 72 | 30 |
| Ex. 12 | A | 12 | 17.6 | 70.4 | 30 |
| Ex. 13 | A | 15 | 17 | 68 | 30 |
| Comp. 1 | A | | bare surface | | none |

Samples thus prepared are tested for their performance.

Surface electrical resistivity (SER) is measured with a Keithly model 616 digital electrometer using a two point DC probe by a method similar to that described in U.S. Pat. No. 2,801,191 (col.4, lines 4–34). Internal resistivity or "water electrode resistivity (WER)" is measured by the procedures described in R. A. Elder, "Resistivity Measurement on Buried Conductive Layers," EOS/ESD Symposium Proceedings, September 1990, pages 251–254.

For backmark retention, a printed image is applied onto the antistat coated surface using a dot matrix printer. The support is then subjected to a conventional color paper developer solution for 30 seconds, washed with warm water for 5 seconds and rubbed for print retention evaluation. The following ratings are assigned, with numbers 1–3 indicating acceptably good performance.

1=Outstanding, very little difference between processed and unprocessed appearance.

2=Excellent, slight degradation of appearance

3=Acceptable, medium degradation of appearance

4=Unacceptable, serious degradation of appearance

5=Unacceptable, total degradation.

The test results from samples Ex. 1–13 and Comp. 1 are listed in

TABLE 1B

Table 1B.

| Sample | SER log ohms/square | BMR |
|---|---|---|
| Ex. 1 | 10.3 | 1–2 |
| Ex. 2 | 9.6 | |
| Ex. 3 | 9.1 | 1–2 |
| Ex. 4 | 8.6 | |
| Ex. 5 | 8.4 | |
| Ex. 6 | 8.2 | 1–2 |
| Ex. 7 | 7.9 | |
| Ex. 8 | 10.2 | 1–2 |
| Ex. 9 | 9.3 | |
| Ex. 10 | 8.9 | 1–2 |
| Ex. 11 | 8.2 | |
| Ex. 12 | 7.9 | 1–2 |
| Ex. 13 | 7.3 | |
| Comp. 1 | >13.9 | |

It is clear that the coated antistatic layers on samples Ex. 1–13, prepared as per the invention, impart electrically conductive means to the synthetic paper support. Without any antistatic layer, as in Comp. 1, the support is highly insulating. This difference is reflected in the SER values of samples Ex. 1–13 and Comp. 1. Moreover, samples Ex. 1–13 also demonstrate outstanding to excellent backmark retention characteristics, further proving their desirability as print imaging media, such as color photographic paper.

Support for Antistatic Layers Formed From Thermally Processable Compositions

Support B used in the working examples described herein below comprises a foam core and an upper and lower flange similar to support A, except the antistatic layer is extrusion coated either over the lower flange surface or between the closed cell foam core and the lower flange, during support manufacturing.

Thermally Processable Antistatic Compositions

The thermally processable antistatic compositions used in the working examples comprise the following ingredients:

Conductive material:

Polyether-block-polyamide Pebax ® 1074 supplied by Atofina.

Matrix polymer:

Polypropylene PF611 ® supplied by Basell.

Compatibilizer

Maleic anhydride functionalized polypropylene Orevac ® CA 100 supplied by Atofina Samples Ex. 14 and 15 are prepared by incorporating a thermally processable antistatic layer in Support B, by extrusion coating at 232° C. The antistatic layer is placed over the lower flange in Ex. 14 and between the lower flange and the foam core in Ex. 15. Details about the composition of the samples and their electrical resistivity (SER for Ex. 14 and WER for Ex. 15) are listed in Table 2.

TABLE 2

| | | | antistatic layer composition | | | | |
|---|---|---|---|---|---|---|---|
| Sample | support | location of antistat | Pebax ® wt. % | PF 611 ® wt. % | Orevac ® CA100 wt. % | coverage of antistat layer g/ft$^2$ | SER/WER log ohms/square |
| Ex. 14 | B | Over lower flange | 30 | 67.5 | 2.5 | 3.6 +/− 0.9 | 11.5 |
| Ex. 15 | B | Between foam & lower flange | 30 | 67.5 | 2.5 | 3.6 +/− 0.9 | 11.5 |

It is clear that samples Ex. 14 and 15, prepared in accordance with the present invention, by thermal processing method can impart adequate electrical conductivity to the support, which is otherwise highly insulating.

The invention has been described in detail, with particular reference to certain preferred embodiments thereof, but it should be understood that variations and modifications can be effected within the spirit and scope of the invention.

What is claimed is:

1. An imaging member comprising at least one imaging layer, a base wherein said base comprises a closed cell foam core sheet and an upper and a lower polymer flange sheet adhered thereto, wherein said closed cell foam core sheet comprises a polymer that has been expanded through the use of a blowing agent, wherein said imaging member has a stiffness of between 50 and 250 millinewtons, and is conductive.

2. The imaging member of claim 1 wherein said upper and lower flange sheets each have a modulus greater than the modulus of the closed cell foam core sheet.

3. The imaging member of claim 2 wherein said upper flange sheet and said lower flange sheet each have a modulus between 700 MPa to 10500 Mpa.

4. The imaging member of claim 1 having an upper surface and a lower surface, wherein at least one of said upper surface or lower surface of said base has an average roughness of between 0.1 $\mu$m and 1.1 $\mu$m.

5. The imaging member of claim 1 wherein said foam core sheet has a thickness of between 25 and 350 $\mu$m.

6. The imaging member of claim 1 wherein said foam core sheet comprises polyolefin.

7. The imaging member of claim 1 wherein said base has opacity between 80% and 99%.

8. The imaging member of claim 1 wherein said base has a thickness of between 100 and 400 $\mu$m.

9. The imaging member of claim 1 wherein said imaging layer comprises at least one layer comprising photosensitive silver halide.

10. The imaging member of claim 1 wherein said imaging layer comprises an ink jet receiving layer.

11. The imaging member of claim 1 wherein said imaging layer comprises a thermal dye receiving layer.

12. The imaging member of claim 1 wherein said imaging member is charge balanced.

13. The imaging member of claim 1 wherein said imaging member has a surface or internal electrical resistivity less that 13 log ohms/square.

14. The imaging member of claim 13 wherein said imaging member comprises an ionic conductor.

15. The imaging member of claim 14 wherein said ionic conductor is an inorganic salt.

16. The imaging member of claim 15 wherein said ionic conductor is an alkali metal salt.

17. The imaging member of claim 16 wherein said alkali metal salt is at least one alkali metal salt selected from the group consisting of lithium, sodium and potassium.

18. The imaging member of claim 14 wherein said ionic conductor is a surfactant.

19. The imaging member of claim 18 wherein said surfactant is anionic.

20. The imaging member of claim 18 wherein said surfactant is cationic.

21. The imaging member of claim 14 wherein said ionic conductor is a polymeric salt.

22. The imaging member of claim 21 wherein said polymeric salt is at least one member selected from the group consisting of polystyrene sulfonic acid, napthalene sulfonic acid and alkali cellulose sulfate.

23. The imaging member of claim 14 wherein said ionic conductor further comprises an alkylene oxide.

24. The imaging member of claim 23 wherein said alkylene oxide comprises at least one member selected from the group consisting of polyethylene glycol, polyethylene oxide, and interpolymers of polyethylene oxide.

25. The imaging member of claim 14 wherein said ionic conductor is a thermally processable conducting polymer.

26. The imaging member of claim 25 wherein said thermally processable conducting polymer is polyether-block polyamide.

27. The imaging member of claim 13 wherein said imaging member comprises and electronic conductor.

28. The imaging member of claim 27 wherein said electronic conducing means comprises metal-containing particles.

29. The imaging member of claim 28 wherein said metal containing particles are selected from the group consisting of tin oxide, vanadium oxide, zinc antimonate, and indium antimonate.

30. The imaging member of claim 27 wherein said electronic conductor comprises electronically conducting polymers.

31. The imaging member of claim 30 wherein said electronically conducting polymers are selected from the group consisting of substituted and unsubstituted thiophene containing polymers, substituted and unsubstituted pyrrole containing polymers, and substituted and unsubstituted aniline containing polymers.

32. The imaging member of claim 30 wherein said electronically conducting polymer is poly(3,4-ethylene dioxythiophene styrene sulfonate).

33. The imaging member of claim 1 wherein at least one imaging layer comprises a conductor.

34. The imaging member of claim 1 wherein said base comprises a conductor.

35. The imaging member of claim 1 wherein at least one of said upper flange and said lower flange comprises a conductor.

36. The imaging member of claim 1 wherein said closed cell foam core sheet comprises a conductor.

37. The imaging member of claim 1 further comprising at least one layer containing a conductor.

38. The imaging member of claim 37 wherein said at least one layer containing a conductor is between said closed cell foam core sheet and at least one of said upper flange and said lower flange.

39. The imaging member of claim 37 wherein said at least one layer containing a conductor is between said at least one imaging layer and said upper flange.

40. The imaging member of claim 37 wherein said lower flange is between said at least one layer containing a conductor and said closed cell foam core sheet.

41. The imaging member of claim 37 wherein said at least one layer containing a conductor is between two of said at least one imaging layers.

42. A method of forming a conductive imaging member comprising supplying a base wherein said base comprises a closed cell foam core sheet having a thickness of between 25 and 175 $\mu$m, wherein said closed cell foam core sheet comprises a polymer that has been expanded through the use of a blowing agent, adhering a polymer flange material to each side of said foam core sheet, and adding at least one imaging layer, wherein said imaging member has a stiffness of between 50 and 250 millinewtons and is conductive.

43. The method of claim 42 wherein said upper and lower flange sheets have a modulus greater than the modulus of the closed cell foam core sheet.

44. The method of claim 43 wherein said upper and lower flange sheet modulus is between 700 MPa to 10500 Mpa.

45. The method of claim 42 wherein said imaging member has a surface or internal electrical resistivity less that 13 log ohms/square.

46. The method of claim 42 wherein said at least one imaging layer comprises a conductor.

47. The method of claim 42 wherein said base comprises a conductor.

48. The method of claim 42 wherein at least one of said upper flange and said lower flange comprises a conductor.

49. The method of claim 42 wherein said closed cell foam core sheet comprises a conductor.

* * * * *

UNITED STATES PATENT AND TRADEMARK OFFICE

CERTIFICATE OF CORRECTION

PATENT NO. : 6,566,033 B1
DATED : May 20, 2003
INVENTOR(S) : Debasis Majumdar et al.

It is certified that error appears in the above-identified patent and that said Letters Patent is hereby corrected as shown below:

Column 22,
Line 67, “that” change to -- than --

Column 23,
Line 32, “and” change to -- an --

Column 24,
Line 39, “that” change to -- than --

Signed and Sealed this

Eleventh Day of May, 2004

JON W. DUDAS
*Acting Director of the United States Patent and Trademark Office*